US011187094B2

(12) United States Patent
Feldmann et al.

(10) Patent No.: US 11,187,094 B2
(45) Date of Patent: Nov. 30, 2021

(54) SPLINE FOR A TURBINE ENGINE

(71) Applicant: General Electric Company, Schenectady, NY (US)

(72) Inventors: Kevin Robert Feldmann, Mason, OH (US); Robert Proctor, Mason, OH (US); David Scott Stapleton, Boston, MA (US); Robert Charles Groves, II, West Chester, OH (US)

(73) Assignee: General Electric Company, Schenectady, NY (US)

( * ) Notice: Subject to any disclaimer, the term of this patent is extended or adjusted under 35 U.S.C. 154(b) by 147 days.

(21) Appl. No.: 16/550,363

(22) Filed: Aug. 26, 2019

(65) Prior Publication Data

US 2021/0062666 A1 Mar. 4, 2021

(51) Int. Cl.
*F01D 11/00* (2006.01)
*F01D 9/02* (2006.01)

(52) U.S. Cl.
CPC ..... *F01D 11/005* (2013.01); *F01D 9/02* (2013.01); *F05D 2240/11* (2013.01); *F05D 2240/128* (2013.01); *F05D 2240/35* (2013.01); *F05D 2240/55* (2013.01)

(58) Field of Classification Search
CPC ..... F01D 11/003; F01D 11/005; F01D 11/08; F05D 2240/11; F05D 2240/55; F05D 2250/12; F05D 2250/72; F05D 2270/112
See application file for complete search history.

(56) References Cited

U.S. PATENT DOCUMENTS 4,524,980 A * 6/1985 Lillibridge ..... F01D 11/008 277/641
5,709,530 A * 1/1998 Cahill ..... F01D 11/005 277/644
6,340,285 B1 1/2002 Gonyou et al.
7,625,174 B2 * 12/2009 Drerup ..... F01D 9/041 415/135
8,182,208 B2 * 5/2012 Bridges, Jr. ..... F01D 11/005 415/139
8,240,985 B2 * 8/2012 Martin ..... F01D 11/005 415/173.1
8,308,428 B2 * 11/2012 Bridges, Jr. ..... F01D 9/041 415/139
8,727,710 B2 * 5/2014 Propheter-Hinckley ..... F01D 11/005 415/139
8,753,073 B2 6/2014 Albers et al.
9,810,086 B2 11/2017 Correia et al.
2004/0017050 A1 1/2004 Burdgick
2006/0182624 A1 * 8/2006 London ..... F01D 11/008 415/170.1

(Continued)

FOREIGN PATENT DOCUMENTS

EP 0989287 A3 3/2001

*Primary Examiner* — Woody A Lee, Jr.
*Assistant Examiner* — Brian O Peters
(74) *Attorney, Agent, or Firm* — McGarry Bair PC

(57) ABSTRACT

An assembly for a turbine engine comprising a plurality of circumferentially arranged segments having first and second confronting end faces. The first and second confronting end faces include a multi-channel spline seal assembly. The multi-channel spline seal assembly includes at least a first and second channel wherein confronting first or second channels can receive at least one spline seal.

20 Claims, 11 Drawing Sheets

(56) References Cited

U.S. PATENT DOCUMENTS

| | | | | |
|---|---|---|---|---|
| 2016/0084109 | A1* | 3/2016 | Pula | F01D 25/12 60/39.83 |
| 2017/0218784 | A1 | 8/2017 | Feldmann et al. | |
| 2017/0284214 | A1 | 10/2017 | Albert et al. | |
| 2018/0340437 | A1* | 11/2018 | Groves, II | F01D 11/005 |
| 2018/0355741 | A1 | 12/2018 | Groves, II et al. | |
| 2019/0040758 | A1* | 2/2019 | Quennehen | F01D 11/08 |

* cited by examiner

SPLINE FOR A TURBINE ENGINE

TECHNICAL FIELD

This invention relates generally to turbine engine with a multi-channel spline seal, and more particularly to at least one intersection of the channels of the multi-channel spline seal.

BACKGROUND

Turbine engines, and particularly gas or combustion turbine engines, are rotary engines that extract energy from a flow of combusted gases passing through the engine onto a multitude of rotating turbine blades.

A turbine engine includes but is not limited to, in serial flow arrangement, a forward fan assembly, an aft fan assembly, a high-pressure compressor for compressing air flowing through the engine, a combustor for mixing fuel with the compressed air such that the mixture may be ignited, and a high-pressure turbine. The high-pressure compressor, combustor and high-pressure turbine are sometimes collectively referred to as the core engine.

Traditionally, turbine engines use rotating blades and stationary vanes to extract energy. However, some turbine engines include at least one turbine rotating in an opposite direction than the other rotating components within the engine. Components are often arranged circumferentially and require different seals between components to ensure proper flow of the gases.

BRIEF DESCRIPTION

In one aspect, the present disclosure relates to a turbine engine that includes an inner rotor/stator and having a longitudinal axis, an outer rotor/stator circumscribing at least a portion of the inner rotor/stator, with at least one of the inner or outer rotor/stator rotating about the longitudinal axis, and having at least one component comprising a plurality of circumferentially arranged component segments having confronting pairs of circumferential ends, a multi-channel spline seal that includes a first set of first and second channels located in one of the circumferential ends, the first and second channels intersecting to form an intersection, the first channel having a first depth at the intersection, the second channel having a second depth at the intersection, and the second depth being greater than the first depth to define a ledge adjacent the first channel, and a spline seal located within the second channel and having a width at the intersection such that the spline seal at least partially covers the first channel and at least partially overlies the ledge.

In another aspect, the present disclosure relates to a component for a turbine engine that includes a plurality of circumferentially arranged component segments having confronting pairs of circumferential ends, and a multi-channel spline seal that includes a first set of first and second channels located in one of the circumferential ends, the first and second channels intersecting to form an intersection, the first channel having a first depth at the intersection, the second channel having a second depth at the intersection, and the second depth being greater than the first depth to define a ledge adjacent the first channel, and a spline located within the second channel and having a width at the intersection such that the spline at least partially covers the first channel and at least partially overlies the ledge.

DETAILED DESCRIPTION

Figure 1:
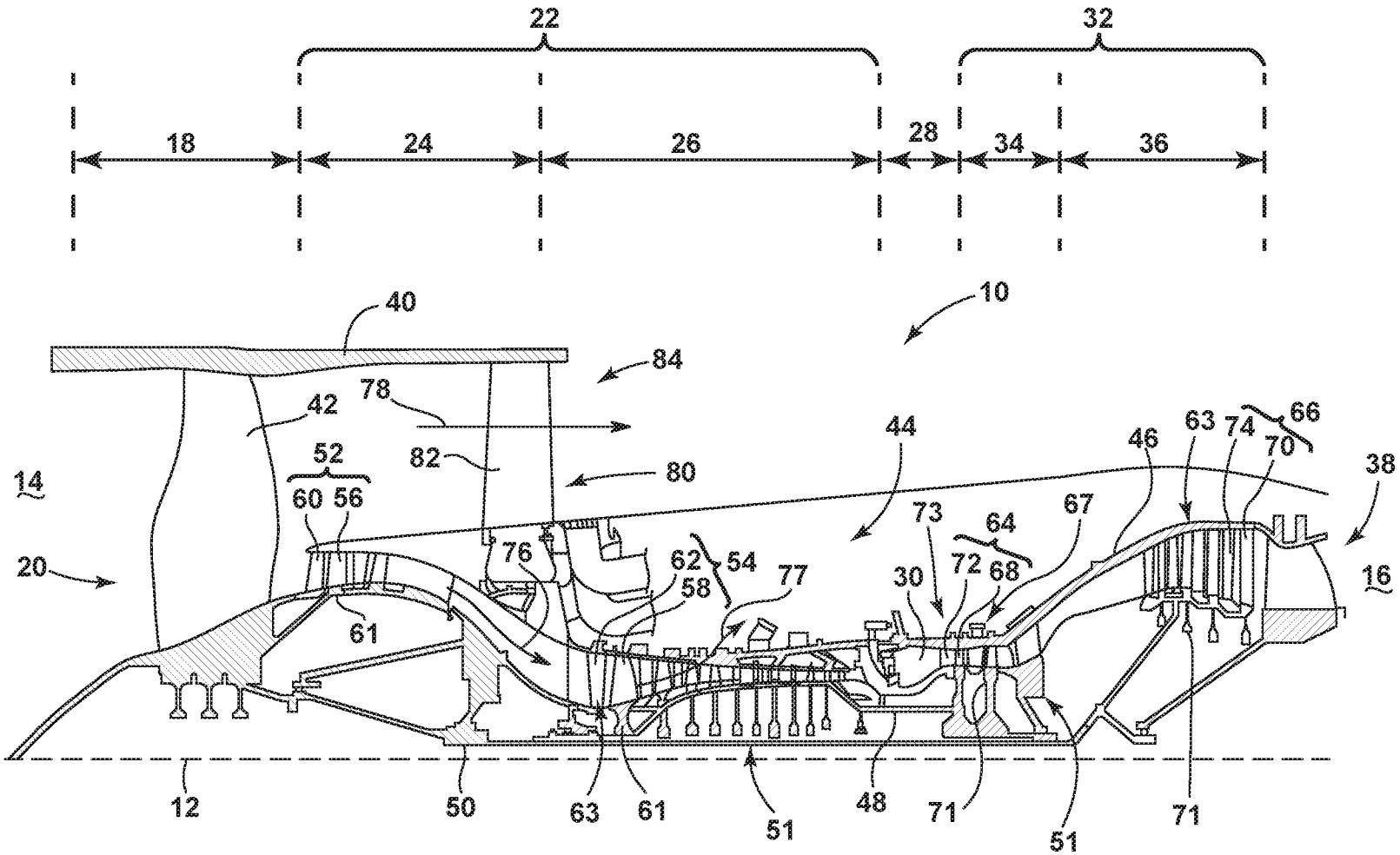
FIG. 1 is a schematic, sectional view of a gas turbine engine.

Aspects of the disclosure relate to a multi-channel spline seal between two components of a turbine engine. For the purposes of description, the multi-channel spline seal will be described as sealing portions between two adjacent and circumferentially arranged shrouds. It will be understood, however, that aspects of the disclosure described herein are not so limited and may have general applicability within other devices related to routing air flow in a turbine engine, such as blade platforms, vanes segments, pairs of vanes forming a nozzle, or nozzle segments, for example. It will be further understood that aspects of the disclosure described herein are not so limited and may have general applicability in non-aircraft applications, such as other mobile applications and non-mobile industrial, commercial, and residential applications.

As used herein, the term "upstream" refers to a direction that is opposite the fluid flow direction, and the term "downstream" refers to a direction that is in the same direction as the fluid flow. The term "fore" or "forward" means in front of something and "aft" or "rearward" means behind something. When used in terms of fluid flow, fore/forward means upstream and aft or rearward means downstream. Additionally, as used herein, the terms "radial" or "radially" refer to a direction away from a common center. In the context of a turbine engine, radial refers to a direction along a ray extending between a center longitudinal axis of the engine and an outer engine circumference. Furthermore, as used herein, the term "set" or a "set" of elements can be any number of elements, including only one.

All directional references (e.g., radial, axial, proximal, distal, upper, lower, upward, downward, left, right, lateral, front, back, top, bottom, above, below, vertical, horizontal, clockwise, counterclockwise, upstream, downstream, forward, aft, etc.) are only used for identification purposes to aid the reader's understanding of the present disclosure, and do not create limitations, particularly as to the position, orientation, or use of aspects of the disclosure described herein. Connection references (e.g., attached, coupled, secured, fastened, connected, and joined) are to be construed broadly and can include intermediate members between a collection of elements and relative movement between elements unless otherwise indicated. As such, connection references do not necessarily infer that two elements are directly connected and in fixed relation to one another. The exemplary drawings are for purposes of illustration only and the dimensions, positions, order and relative sizes reflected in the drawings attached hereto can vary.

FIG. 1 is a schematic cross-sectional diagram of a turbine engine 10 for an aircraft. The engine 10 has a centerline or longitudinal axis 12 extending forward 14 to aft 16. The engine 10 includes, in downstream serial flow relationship, a fan section 18 including a fan 20, a compressor section 22 including a booster or low pressure (LP) compressor 24 and a high pressure (HP) compressor 26, a combustion section 28 including a combustor 30, a turbine section 32 including a HP turbine 34, and a LP turbine 36, and an exhaust section 38.

The fan section 18 includes a fan casing 40 surrounding the fan 20. The fan 20 includes a plurality of fan blades 42 disposed radially about the longitudinal axis 12. The HP compressor 26, the combustor 30, and the HP turbine 34 form an engine core 44, which generates combustion gases. The engine core 44 is surrounded by core casing 46, which can be coupled with the fan casing 40.

A HP shaft or spool 48 disposed coaxially about the longitudinal axis 12 of the engine 10 drivingly connects the HP turbine 34 to the HP compressor 26. A LP shaft or spool 50, which is disposed coaxially about the longitudinal axis 12 of the engine 10 within the larger diameter annular HP spool 48, drivingly connects the LP turbine 36 to the LP compressor 24 and fan 20. The spools 48, 50 are rotatable about the engine centerline and couple to a plurality of rotatable elements, which can collectively define an inner rotor/stator 51. While illustrated as a rotor, it is contemplated that the inner rotor/stator 51 can be a stator.

The LP compressor 24 and the HP compressor 26 respectively include a plurality of compressor stages 52, 54, in which a set of compressor blades 56, 58 rotate relative to a corresponding set of static compressor vanes 60, 62 (also called a nozzle) to compress or pressurize the stream of fluid passing through the stage. In a single compressor stage 52, 54, multiple compressor blades 56, 58 can be provided in a ring and can extend radially outwardly relative to the longitudinal axis 12, from a blade platform to a blade tip, while the corresponding static compressor vanes 60, 62 are positioned upstream of and adjacent to the rotating compressor blades 56, 58. It is noted that the number of blades, vanes, and compressor stages shown in FIG. 1 were selected for illustrative purposes only, and that other numbers are possible.

The compressor blades 56, 58 for a stage of the compressor can be mounted to a disk 61, which is mounted to the corresponding one of the HP and LP spools 48, 50, with each stage having its own disk 61. The vanes 60, 62 for a stage of the compressor can be mounted to the core casing 46 in a circumferential arrangement.

The HP turbine 34 and the LP turbine 36 respectively include a plurality of turbine stages 64, 66, in which a set of turbine blades 68, 70 are rotated relative to a corresponding set of static turbine vanes 72, 74 (also called a nozzle) to extract energy from the stream of fluid passing through the stage. In a single turbine stage 64, 66, multiple turbine blades 68, 70 can be provided in a ring and can extend radially outwardly relative to the longitudinal axis 12, from a blade platform to a blade tip, while the corresponding static turbine vanes 72, 74 are positioned upstream of and adjacent to the rotating blades 68, 70. It is noted that the number of blades, vanes, and turbine stages shown in FIG. 1 were selected for illustrative purposes only, and that other numbers are possible.

The blades 68, 70 for a stage of the turbine can be mounted to a disk 71, which is mounted to the corresponding one of the HP and LP spools 48, 50, with each stage having a dedicated disk 71. The vanes 72, 74 for a stage of the compressor can be mounted to the core casing 46 in a circumferential arrangement.

Complementary to the rotor portion, the stationary portions of the engine 10, such as the static vanes 60, 62, 72, 74 among the compressor and turbine section 22, 32 are also referred to individually or collectively as an outer rotor/stator stator 63. As illustrated, the outer rotor/stator 63 can refer to the combination of non-rotating elements throughout the engine 10. Alternatively, the outer rotor/stator 63 that circumscribes at least a portion of the inner rotor/stator 51, can be designed to rotate. The inner or outer rotor/stator 51, 63 can include at least one component that can be, by way of non-limiting example, a shroud, vane, nozzle, nozzle body, combustor, hanger, or blade, where the at least one component is a plurality of circumferentially arranged component segments having confronting pairs of circumferential ends.

In operation, the airflow exiting the fan section 18 is split such that a portion of the airflow is channeled into the LP compressor 24, which then supplies pressurized airflow 76 to the HP compressor 26, which further pressurizes the air. The pressurized airflow 76 from the HP compressor 26 is mixed with fuel in the combustor 30 and ignited, thereby generating combustion gases. Some work is extracted from these gases by the HP turbine 34, which drives the HP compressor 26. The combustion gases are discharged into the LP turbine 36, which extracts additional work to drive the LP compressor 24, and the exhaust gas is ultimately discharged from the engine 10 via the exhaust section 38. The driving of the LP turbine 36 drives the LP spool 50 to rotate the fan 20 and the LP compressor 24.

A portion of the pressurized airflow 76 can be drawn from the compressor section 22 as bleed air 77. The bleed air 77 can be drawn from the pressurized airflow 76 and provided to engine components requiring cooling. The temperature of pressurized airflow 76 entering the combustor 30 is significantly increased. As such, cooling provided by the bleed air 77 is necessary for operating of such engine components in the heightened temperature environments.

A remaining portion of the airflow 78 bypasses the LP compressor 24 and the engine core 44 and exits the engine assembly 10 through a stationary vane row, and more particularly an outlet guide vane assembly 80, comprising a plurality of airfoil guide vanes 82, at the fan exhaust side 84. More specifically, a circumferential row of radially extending airfoil guide vanes 82 are utilized adjacent the fan section 18 to exert some directional control of the airflow 78.

Some of the air supplied by the fan 20 can bypass the engine core 44 and be used for cooling of portions, especially hot portions, of the engine 10, and/or used to cool or power other aspects of the aircraft. In the context of a turbine engine, the hot portions of the engine are normally downstream of the combustor 30, especially the turbine section 32, with the HP turbine 34 being the hottest portion as it is directly downstream of the combustion section 28. Other sources of cooling fluid can be, but are not limited to, fluid discharged from the LP compressor 24 or the HP compressor 26.

Figure 2:
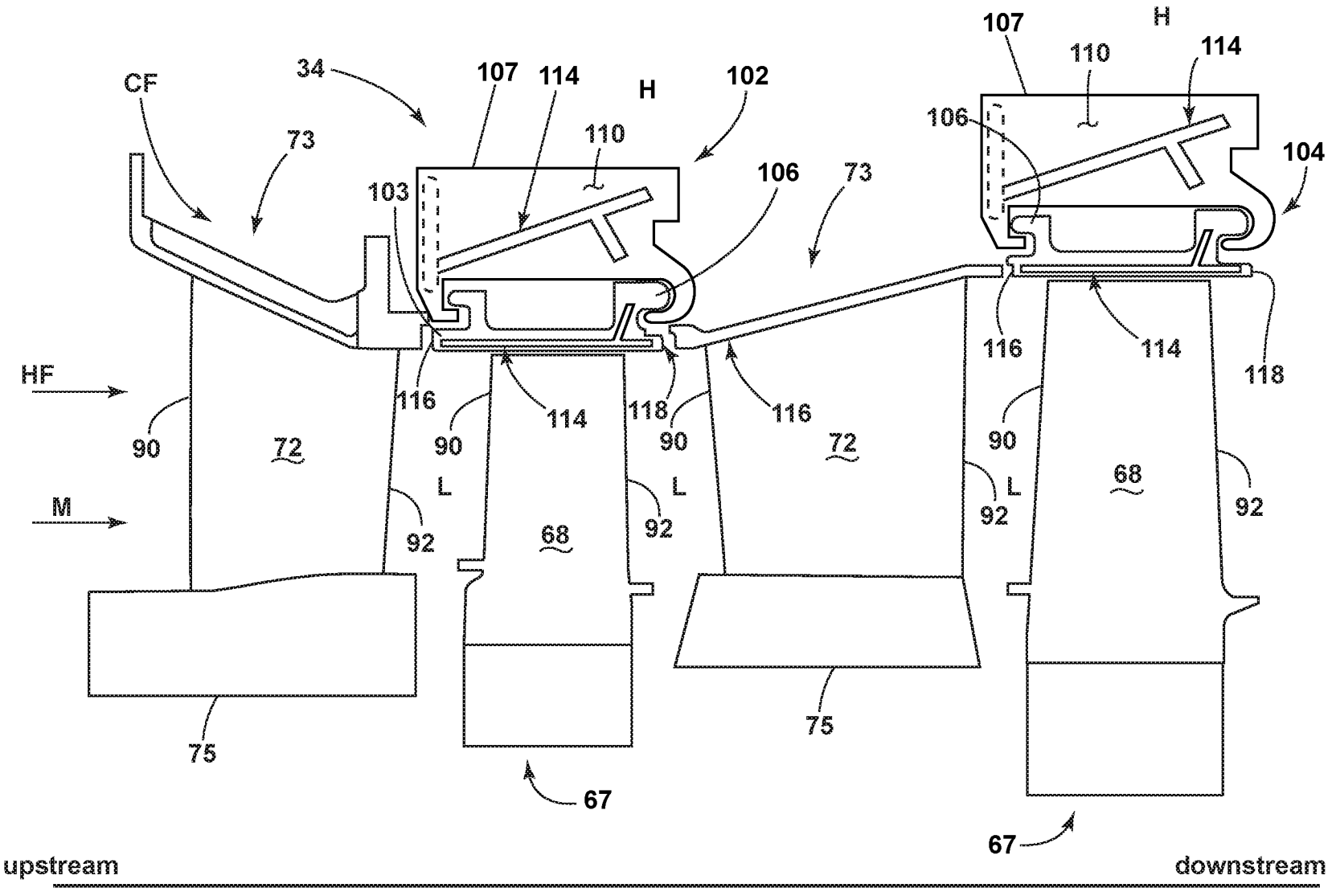
FIG. 2 is a schematic, sectional view of a blade assembly and a nozzle assembly of the gas turbine of FIG. 1.

FIG. 2 illustrates the blade assembly 67 and the nozzle assembly 73 of the HP turbine 34. The nozzle assembly 73 can couple to or include a nozzle seal body 75. The blade assembly 67 includes the set of turbine blades 68. Each of the blades 68 and vanes 72 have a leading edge 90 and a trailing edge 92. The blade assembly 67 is encircled by at least one component, a peripheral assembly 102 with a plurality of circumferentially arranged component segments or peripheral walls 103 around the blades 68. The peripheral assembly 102 defines a mainstream flow M and can circumferentially encompass blades, vanes, or other airfoils circumferentially arranged within the engine 10.

In the illustrated example, the peripheral assembly 102 is a shroud assembly 104 with a shroud segment 106 and hanger segment 107 having opposing and confronting pairs of circumferential ends herein referred to as confronting end faces 110. A spline seal 114 for a multi-channel intersection can extend along the confronting end faces 110 of the shroud segment 106. Additionally, or alternatively, the spline seal 114 can extend along the confronting end faces 110 of the hanger segment 107. Each shroud segment 106 or hanger segment 107 extends axially from a forward edge 116 to an aft edge 118 and at least partially separates an area of relatively high pressure H from an area of relative low pressure L. The shroud segment 106 or the hanger segment 107 at least partially separates a cooling air flow (CF) from a hot air flow (HF) in the turbine engine 10.

Figure 3:
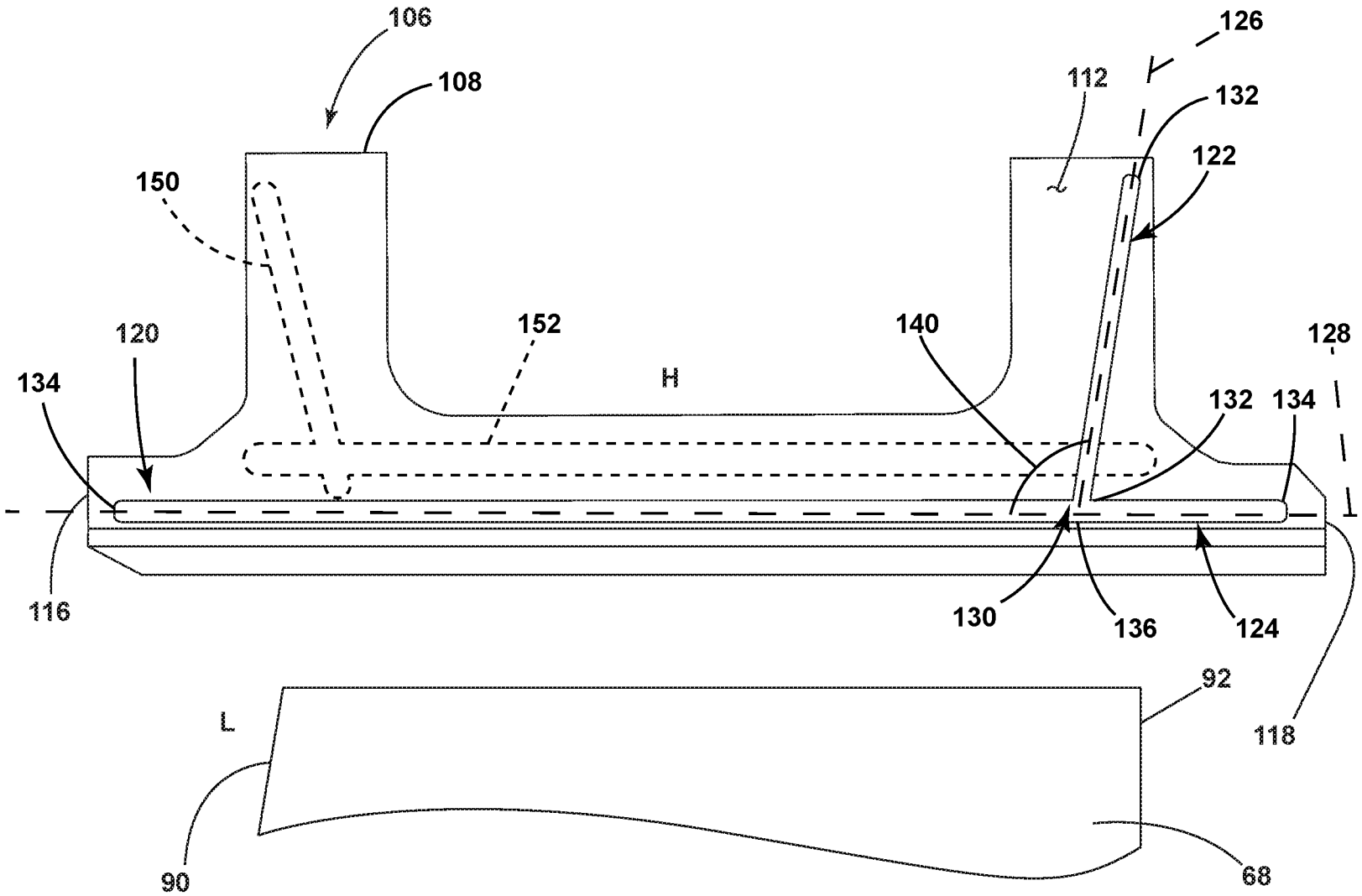
FIG. 3 is a side view of a shroud assembly of a portion of the blade assembly from FIG. 2, with spline seal channels forming an intersection.

FIG. 3 is an enlarged view of a first confronting end face 112 of the confronting end faces 110, of a first shroud segment 108 of the shroud segments 106. A first set of confronting channels 120 is formed in the first confronting end face 112. The first set of confronting channels 120 can include a first channel 122 and a second channel 124, where the first channel 122 has a first centerline 126 and the second channel 124 has a second centerline 128. The first channel 122 can have terminal ends 132. The second channel 124 can have terminal ends 134.

The first and second channels 122, 124 intersect to form an intersection 130. The intersection 130 is illustrated, by way of example, at the terminal end 132 of the first channel 122 and an interim point 136 of the second channel 124. It is contemplated that the intersection 130 can be located at a terminal end 134 of the second channel 124 or the terminal ends 132, 134 of the first and second channels 122, 124. It is further contemplated that the intersection 130 can be at any location where the first and second channels 122, 124 overlap including any interim point or point between the terminal ends 132, 134 of the first and second channels 122, 124.

The first and second channels 122, 124 intersect at an angle 140. The angle 140 can be defined from the first centerline 126 of the first channel 122 to the second centerline 128 of the second channel 124. The angle 140 can be, as illustrated, non-right angle. Alternatively, the angle 140 can be any angle greater than 0 degrees and less than 180 degrees.

It is contemplated that a third channel 150 or a fourth channel 152 can be formed in the first confronting end face 112. The third or the fourth channel 150, 152 can intersect the first channel 122, the second channel 124, or each other. It is further contemplated that any number of channels can formed in the first confronting face 112 that can then provide any number of intersections.

It is by way of non-limiting example that the channels 122, 124, 150, 152 are illustrated having openings that are generally shaped as an obround. The channels 122, 124, 150, 152 can have any number of curves, contours, inflections, or overall shapes.

Figure 4:
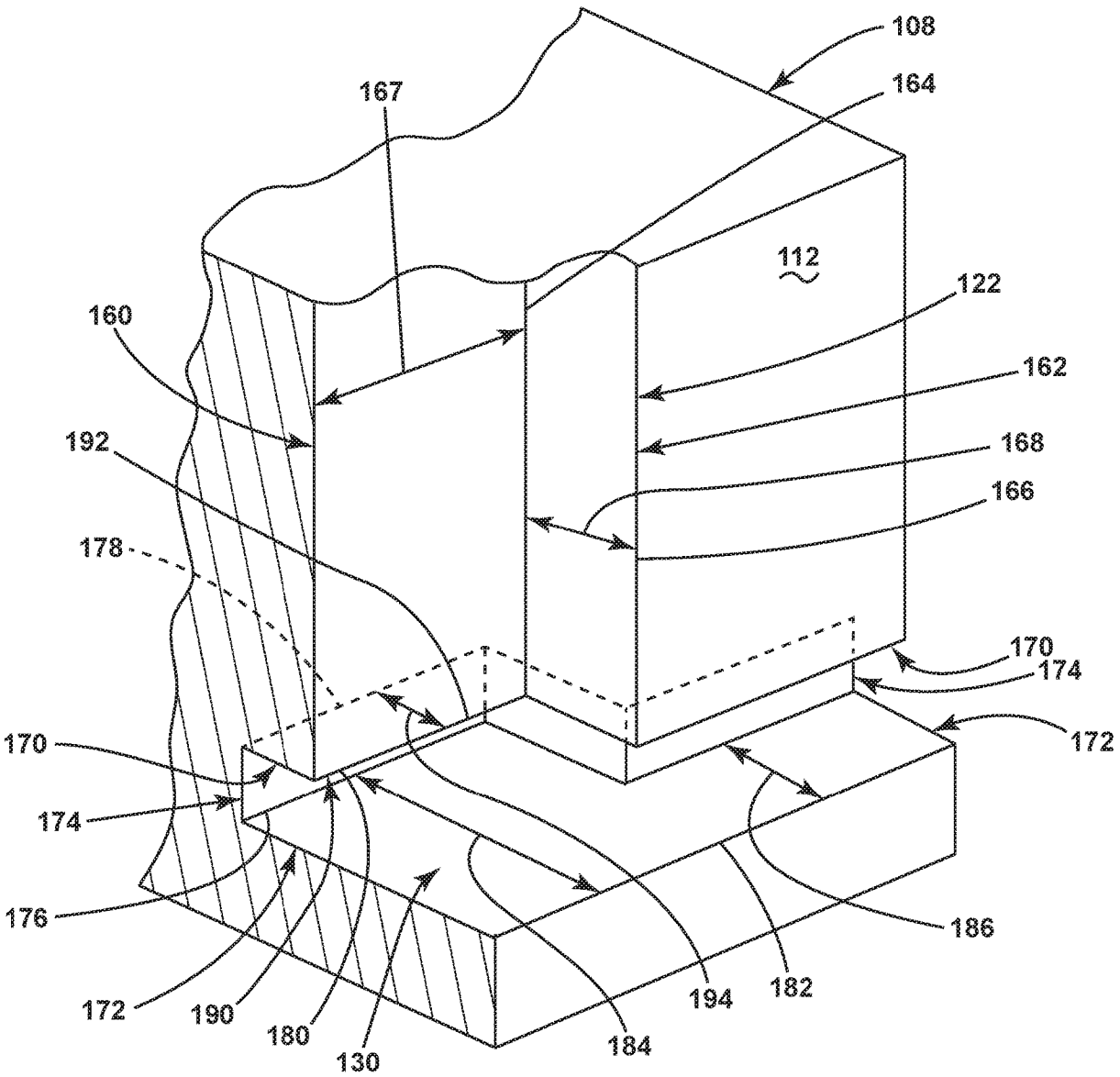
FIG. 4 is a schematic cross section of a portion of the shroud assembly of FIG. 3 taken at the intersection.

FIG. 4 is a schematic cross section taken at the intersection 130 of the first and second channels 122, 124 of FIG. 3. The dimensions of the schematic figures are not to scale.

The first channel 122 can include an outside wall 160 and a side wall 162 that join at an inner corner 164. An outer corner 166 is defined as the point at which the side wall 162 abuts the first confronting end face 112. A first depth 168 of the first channel 122 at the intersection 130 can be measured from the outer corner 166 to the inner corner 164. A first channel length 167 can be measured between the side wall 162 and an opposing side wall (not shown) of the first channel 122.

The second channel 124 can have a top wall 170 and bottom wall 172 joined by a back wall 174. A top edge 180 is defined by the top wall 170 abutting the first confronting end face 112. A bottom edge 182 is defined by the bottom wall 172 abutting the first confronting end face 112. A lower back junction 176 is defined by where the back wall 174 abuts the bottom wall 172. An upper back junction 178 is defined where the back wall 174 abuts the top wall 170.

A second depth 184 of the second channel 124 can be measured from the bottom edge 182 to the back wall 174 or the lower back junction 176 at the intersection 130. An alternative depth 186 can be measured from the bottom edge 182 to the back wall 174 the lower back junction 176 at a position in the second channel 124 other than the intersection 130. It is contemplated that the alternative depth 186 is less than the second depth 184. Alternatively, the second depth 184 can extend for any length of the second channel 124, including the entire length of the second channel 124 between terminal ends 134.

Therefore, the first channel 122 has the first depth 168 at the intersection 130 and the second channel 124 has the second depth 184 at the intersection 130, where the second depth 184 is greater than the first depth 168.

A ledge 190, adjacent the first channel 122, is defined by the second depth 184 being greater than the first depth 168. The ledge 190 is a portion of the top wall 170 at the intersection 130 extending from the upper back junction 178 to a front edge 192. The front edge 192 of the ledge 190 can be further defined at the intersection 130 as the location at which the outside wall 160 of the first channel 122 and the top wall 170 of the second channel 124 join. The ledge 190 extends a ledge distance 194 from the front edge 192 to the upper back junction 178 of the back wall 174 of the second channel 124.

It is considered that the first channel 122 can intersect and terminate at the second channel 124 from a position below the second channel 124. Different orientations, intersection, and numbers of channels have been considered. It is further considered that the first and second depths 168, 184 can be constant for the length of the corresponding first or second channel 122, 124.

Figure 5:
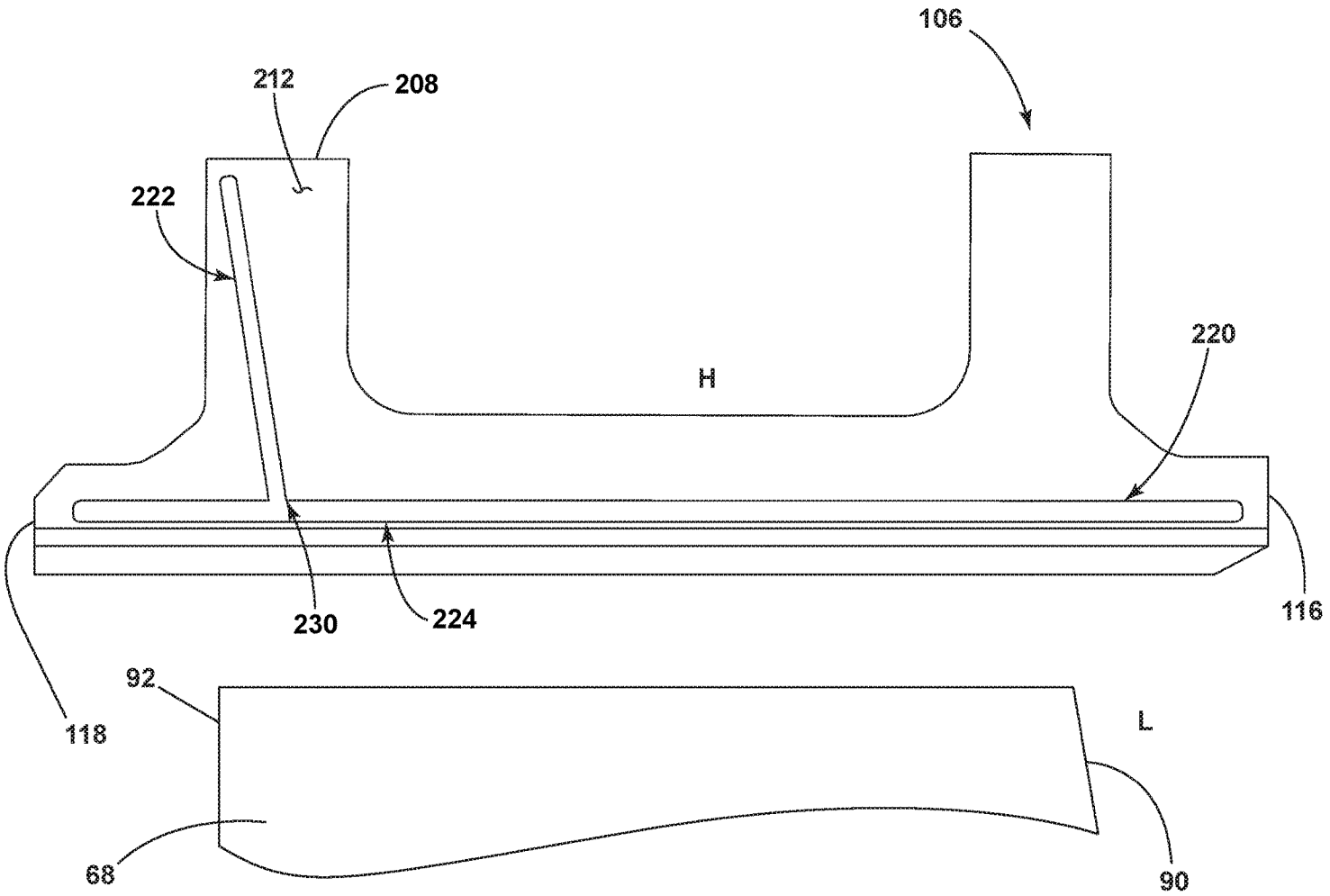
FIG. 5 is another side view of a shroud assembly and a portion of a blade from FIG. 2.

FIG. 5 is an enlarged view of a second confronting end face 212 of a second shroud segment 208 that confronts the first confronting end face 112 of the first shroud segment 108 of FIG. 3. The second confronting end face 212, although not required, can be generally a mirror image of the first confronting end face 112. Therefore, by way non-limiting example, the second confronting end face 212 is similar to the first confronting end face 112, therefore, like parts will be identified with like numerals increased by 100, with it being understood that the description of the like parts of the first confronting end face 112 applies to the second confronting end face 212, unless otherwise noted.

A second set of confronting channels 220 is formed in the second confronting end face 212. The second set of confronting channels 220 can include a first channel 222 and a second channel 224 that interest at an intersection 230. Confronting pairs of first channels 122, 222 and second channels 124, 224 are formed by the first and second confronting end faces 112, 212. In the example shown, the confronting end faces 112, 212 are illustrated in confronting first and second shroud segments 108, 208. However, it will be understood that the confronting end faces 112, 212 can include any suitable stationary or non-stationary component in the turbine engine 10, but not limited to, a vane, nozzle, or blade.

Figure 6:
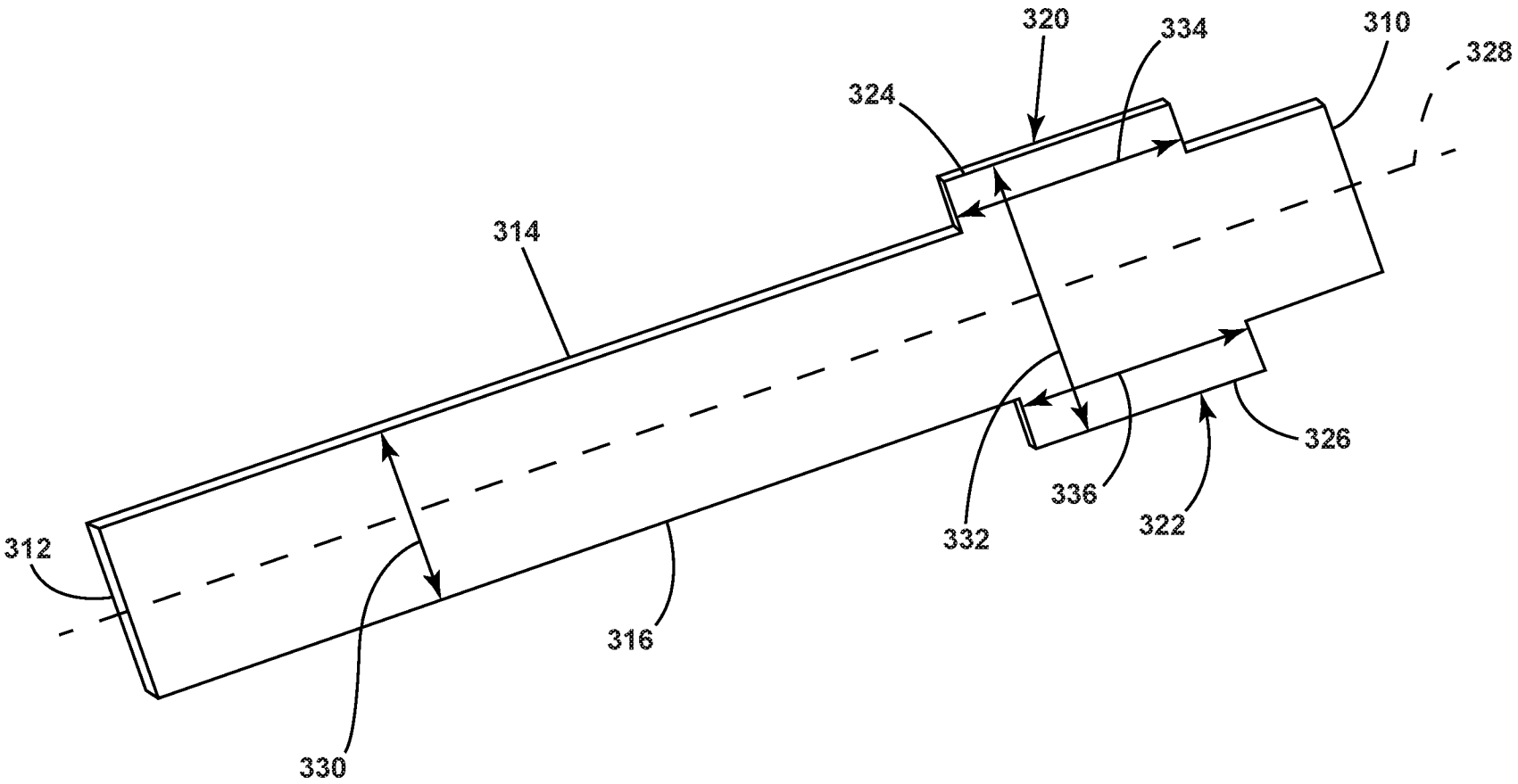
FIG. 6 is a schematic perspective view of a spline seal from the blade assembly of FIG. 2.

Turning to FIG. 6, by way of non-limiting example illustrates a spline seal 114. A multi-channel spline seal can be defined by the spline seal 114 and the first and second sets of confronting channels 120, 220 of first and second channels 122, 124, 222, 224. The spline seal 114 can be generally rectangular with seal terminal ends 310, 312 connected by opposing sides 314, 316 with first and second protruding portions 320, 322 formed on at least one of the sides 314, 316. Boundary edges 324, 326 for the first and second protruding portions 320, 322 can be defined as one or more portions of the first and second protruding portions 320, 322 that extend the farthest from a spline centerline 328. Intersection spline lengths 334, 336 can be defined the length of the first and second protruding portions 320, 322, respectively. The intersection spline lengths 334, 336 of the first and second protruding portions 320, 322 can be measured generally parallel to the spline centerline 328. The intersection spline lengths 334, 336 can be greater than or equal to the first channel length 167. However, it is contemplated that one or both of the intersection spline lengths 334, 336 can be less than the first channel length 167. While the spline seal 114 is illustrated as a symmetric cross-shaped seal, it by way of non-limiting example. It is contemplated that the first and second protruding portions 320, 322 do not have to have the same proportions or be symmetric. It is further contemplated that the protrusions do not have to be rectangular in shape.

An intersection spline width 332 can be defined as the distance between boundary edges 324, 326 of the first and second protruding portions 320, 322. A passage spline width 330 can be defined as the distance between the opposing sides 314, 316 along a path relatively perpendicular to the spline centerline 328 located on a portion of the spline seal 114 that does not include the first or second protruding portions 320, 322. The intersection spline width 332 can be greater than the passage spline width 330.

Figure 7:
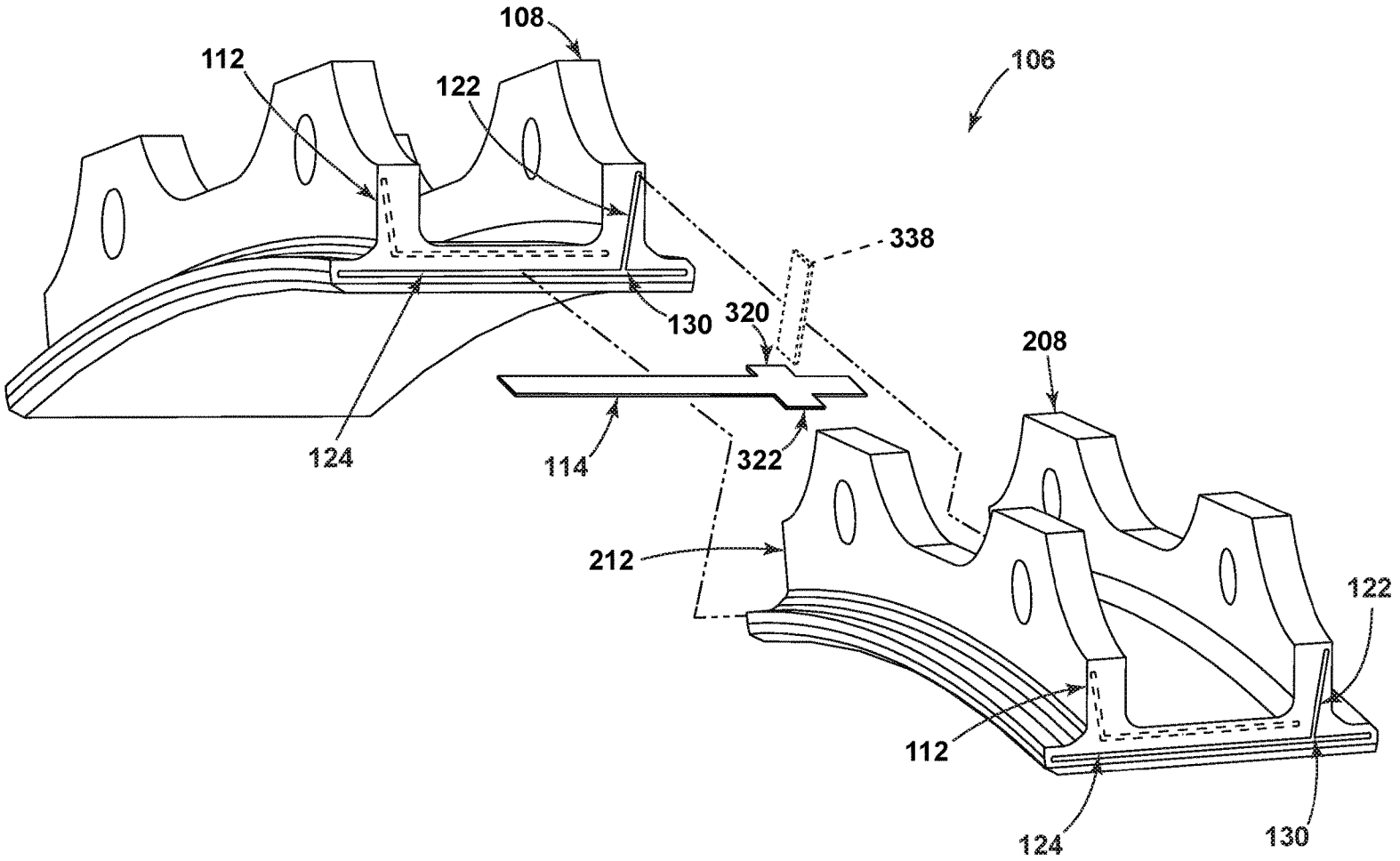
FIG. 7 is an exploded view of confronting first and second shroud segments of the blade assembly of FIG. 2 with the spline seal of FIG. 6.

Turning to FIG. 7, when assembled, the first and second shroud segments 108, 208 are circumferentially arranged with at least one spline seal 114 provided in the second channels 124, 224 that penetrates the first and second confronting end faces 112, 212. The first and second protruding portions 320, 322 of the spline seal 114 can be positioned at the intersections 130, 230. The spline seal 114 can be bendable and shaped to fit contours or other radial variations in the second channels 124, 224.

Optionally, a vertical spline seal 338 can be provided in the first channels 122, 222 that penetrate the first and second confronting end faces 112, 212. It is contemplated that any number of seals can be used between the first and second confronting end faces 112, 212.

Figure 8:
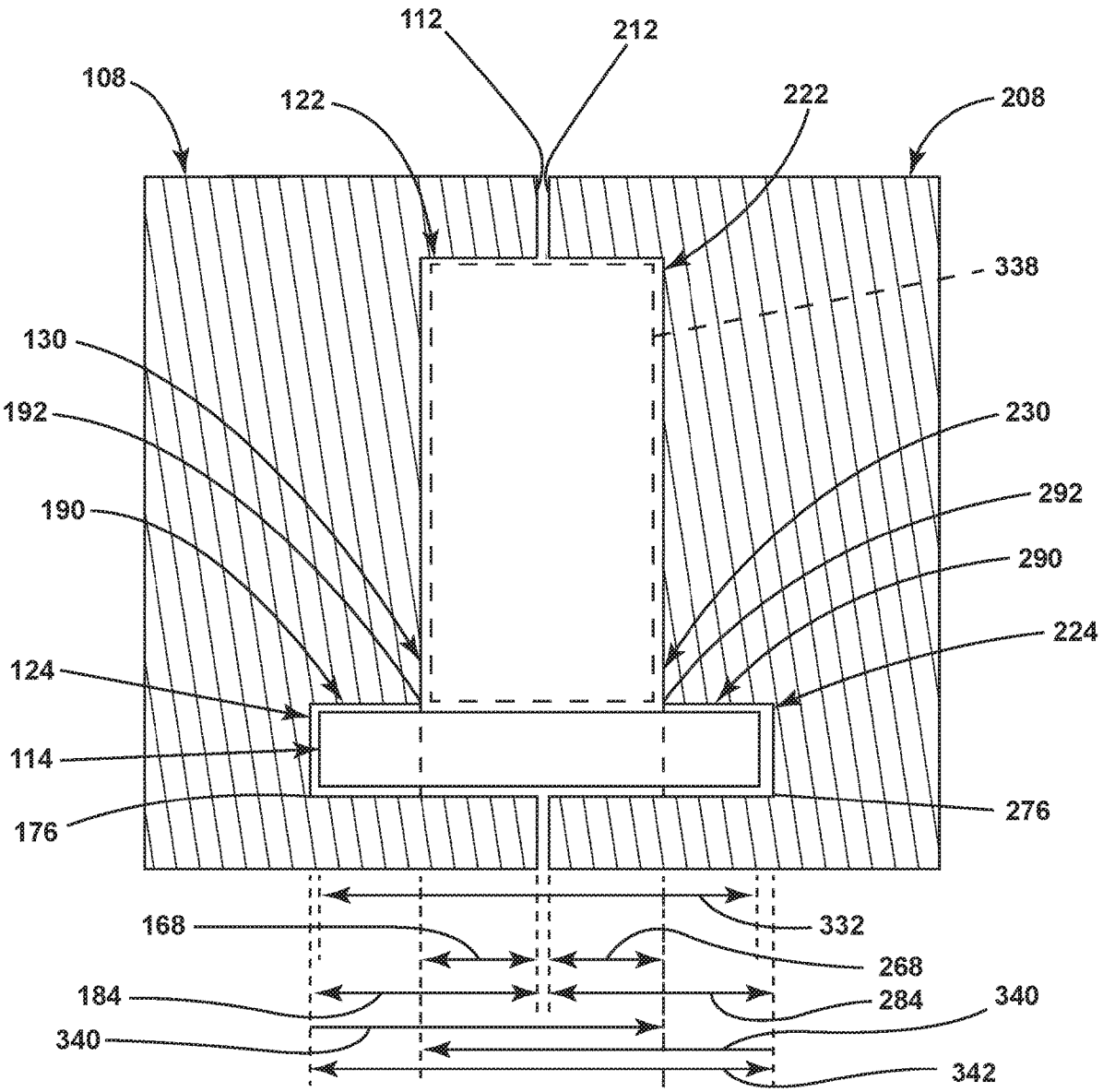
FIG. 8 is a cross section of circumferentially arranged shrouds of FIG. 7 with the spline seal of FIG. 6.

FIG. 8 is a cross section of the first and second shroud segments 108, 208 with the first and second confronting end faces 112, 212 taken at the intersections 130, 230. The similarly to the first depth 168 of the first shroud segment 108, a first depth 268 of the second shroud segment 208 can be defined as the distance from the second confronting face 212 to a front edge 292 adjacent the first channel 222. A second depth 284 can be defined as the distance from the second confronting face 212 to a lower back junction 276 of the second channel 224. At the intersection 230 another ledge 290 can be defined where the second depth 284 of the second channel 224 is greater than the first depth 268 of the first channel 222.

A first dimension 340 can be defined as the distance from a junction to an edge of the confronting ledge. That is, the first dimension 340 can be measure from the lower back junction 176 to the confronting front edge 292. Alternatively, the first dimension 340 can be measured from the lower back junction 276 to the confronting front edge 192. A second dimension 342 can be measured between confronting lower back junctions 176, 276.

The spline seal 114 can at least partially cover both first channels 122, 222 and at least partially overlie both ledges 190, 290 at the intersections 130, 230. That is, the spline seal 114 can extend across or cover at least a portion of the first channels 122, 222. The first and second protruding portions 320, 322 can overlap or overly at least a portion of the ledges 190, 290.

The intersection spline width 332 can be greater than the combined first depths 168, 268 of the first channels 122, 222 and less than or equal to the combined width of the second depth 184, 284 of the second channels 124, 224. That is, the intersection spline width 332 of the spline seal 114 is at least greater than the first dimension 340 and less than or equal to the second dimension 342. In the non-limiting example in which the intersection spline width 332 is greater than the first dimension 340 and less than the second dimension 342, the spline seal 114 will partially overlie at least a portion of the ledges 190, 290. In the example in which the intersection spline width 332 is equal to the combined width of the second depth 184, 284 of the second channels 124, 224, the spline seal 114 will completely overlie at least a portion of the ledges 190, 290 and can extend between the lower back junctions 176, 276.

By way of non-limiting example, the intersection spline lengths 334, 336 can be less than the first channel length 167, resulting in spline seal 114 at least partially covering the first channels 122, 222. In another non-limiting example, the intersection spline lengths 334, 336 can be equal to the first channel length 167, the spline seal 114 can be located such that the first channels 122, 222 are at least partially covered or covered.

In operation, the first and second protruding portions 320, 322 of the spline seal 114 reach from one ledge 190 to the other 290. This provides a better seal and reduces chute leakage from the first channels 122, 222 to the second channels 124, 224 at the confrontation of the first and second shroud segments 108, 208.

Figure 9:
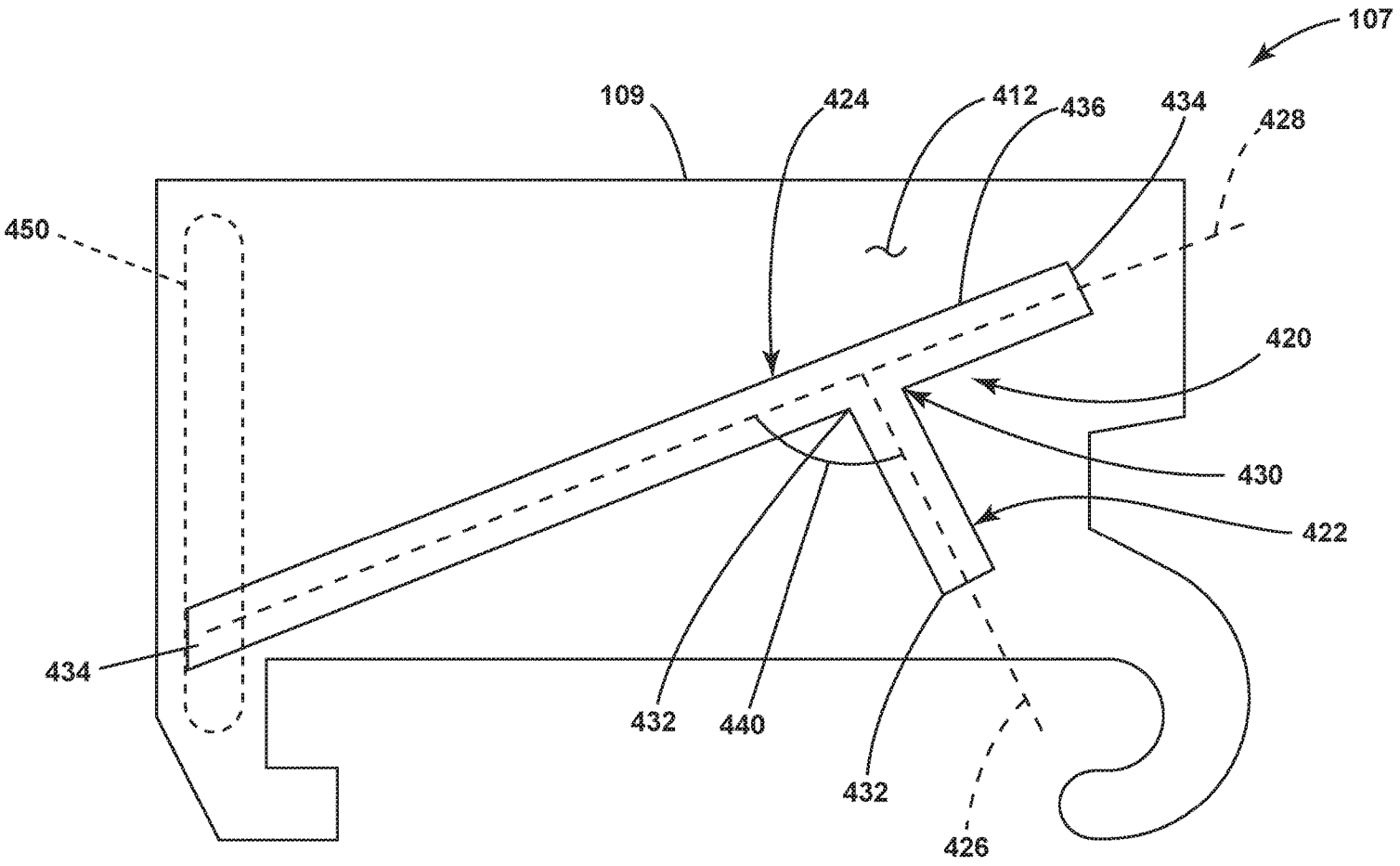
FIG. 9 is a side view of a hanger assembly of a portion of the blade assembly from FIG. 2, with spline seal channels forming an intersection.

FIG. 9 is an enlarged view of a first confronting end face 412 of the confronting end faces 110, of a first hanger segment 109 of the hanger segments 107. A first set of confronting channels 420 is formed in the first confronting end face 412. The first set of confronting channels 420 can include a first channel 422 and a second channel 424, where the first channel 422 has a first centerline 426 and the second channel 424 has a second centerline 428. The first channel 422 can have terminal ends 432. The second channel 424 can have terminal ends 434.

The first and second channels 422, 424 intersect to form an intersection 430. The intersection 430 is illustrated, by way of example, at the terminal end 432 of the first channel 422 and an interim point 436 of the second channel 424. It is contemplated that the intersection 430 can be located at a terminal end 434 of the second channel 424 or the terminal ends 432, 434 of the first and second channels 422, 424. It is further contemplated that the intersection 430 can be at any location where the first and second channels 422, 424 overlap including any interim point or point between the terminal ends 432, 434 of the first and second channels 422, 424.

The first and second channels 422, 424 intersect at an angle 440. The angle 440 can be defined from the first centerline 426 of the first channel 422 to the second centerline 428 of the second channel 424. The angle 440 can be, as illustrated, a right angle. Alternatively, the angle 440 can be any angle greater than 0 degrees and less than 180 degrees.

It is contemplated that a third channel 450 can be formed in the first confronting end face 412. The third channel 450 can intersect the second channel 424, however it is contemplated that the third channel 450 can intersect the first channel 422. It is further contemplated that any number of channels can formed in the first confronting end face 412 that can then provide any number of intersections.

It is by way of non-limiting example that the channels 422, 424, 450 are illustrated having openings that are generally shaped as an obround or rectangular. The channels 422, 424, 450 can have any number of curves, contours, inflections, or overall shapes.

Figure 10:
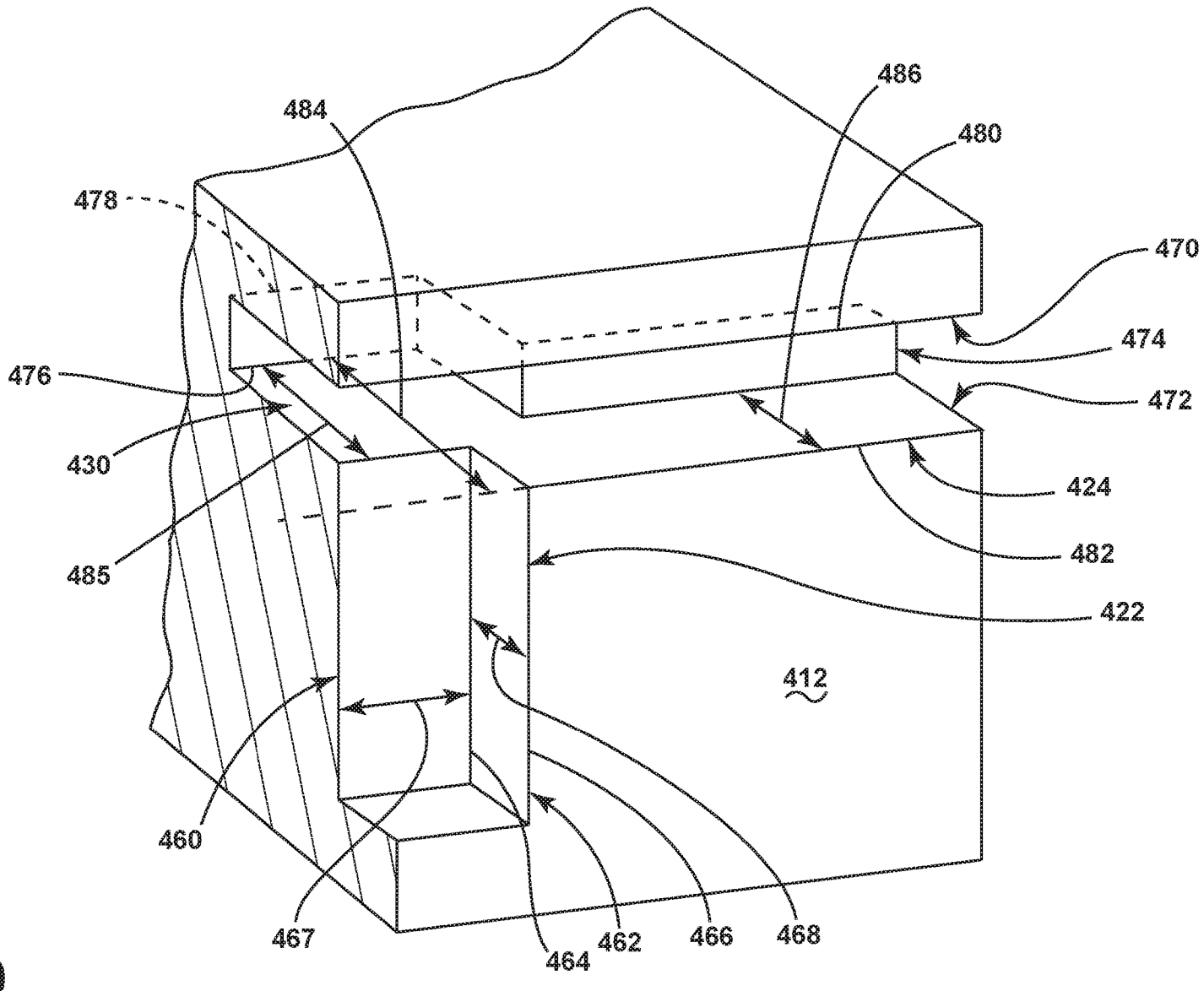
FIG. 10 is a schematic cross section of a portion of the hanger assembly of FIG. 9 taken at the intersection.

FIG. 10 is a schematic cross section taken at the intersection 430 of the first and second channels 422, 424 of FIG. 9. The dimensions of the schematic figures are not to scale.

The first channel 422 can include an outside wall 460 and a side wall 462 that join at an inner corner 464. An outer corner 466 is defined as the point at which the side wall 462 abuts the first confronting end face 412. A first depth 468 of the first channel 422 at the intersection 430 can be measured from the outer corner 466 to the inner corner 464. A first channel length 467 can be measured between the side wall 462 and an opposing side wall (not shown) of the first channel 422.

The second channel 424 can have a top wall 470 and bottom wall 472 joined by a back wall 474. A top edge 480 is defined by the top wall 470 abutting the first confronting end face 412. A bottom edge 482 is defined by the bottom wall 472 abutting the first confronting end face 412. A lower back junction 476 is defined by where the back wall 474 abuts the bottom wall 472. An upper back junction 478 is defined where the back wall 474 abuts the top wall 470.

A ledge 491 is illustrated adjacent to the terminal end 432 of the first channel 422, where the ledge 491 defines a portion of the second channel 424. The ledge 491 is a portion of the bottom wall 472 at the intersection 430 extending from the lower back junction 478 to a front edge 492. The front edge 492 of the ledge 491 can be further defined at the intersection 430 as the location at which the outside wall 460 of the first channel 422 and the bottom wall 472 of the second channel 424 join. A ledge depth 485 can be measured from the front edge 492 to the back wall 474 or the lower back junction 476.

A second depth 484 of the second channel 424 can be measured from an extension of the bottom edge 482 to the back wall 474 or the lower back junction 476 at the intersection 430. An alternative depth 486 can be measured from the bottom edge 482 to the back wall 474 the lower back junction 476 at a position in the second channel 424 other than the intersection 430. It is contemplated that the alternative depth 486 is less than the second depth 484. Alternatively, the second depth 484 can extend for any length of the second channel 424, including the entire length of the second channel 424 between terminal ends 434.

Therefore, the first channel 422 has the first depth 468 at the intersection 430 and the second channel 424 has the second depth 484 at the intersection 430, where the second depth 484 is greater than the first depth 468.

It is considered that the first channel 122 can intersect and terminate at the second channel 124 from a position below the second channel 124. Different orientations, intersection, and numbers of channels have been considered. It is further considered that the first and second depths 168, 184 can be constant for the length of the corresponding first or second channel 122, 124.

Figure 11:
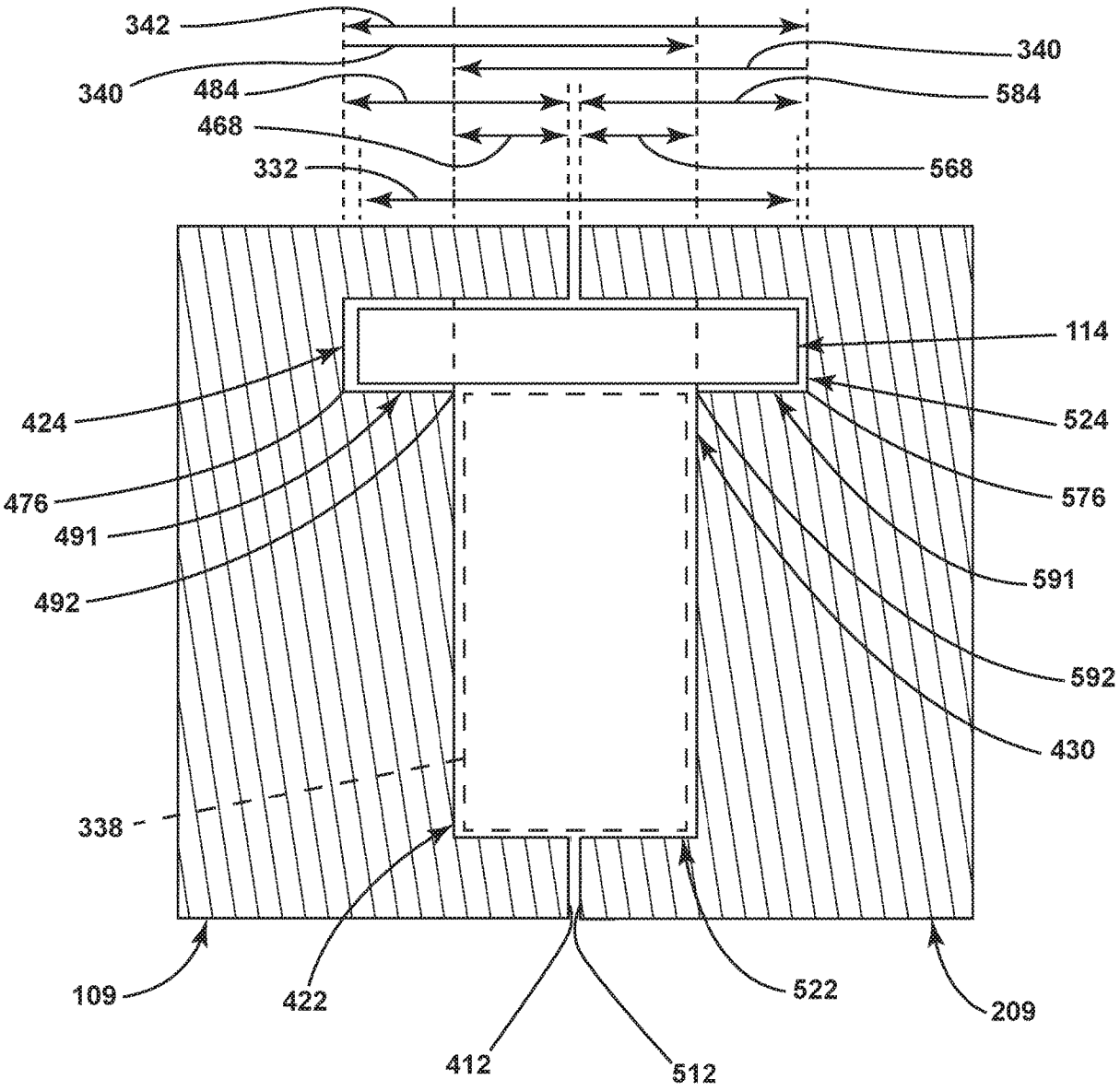
FIG. 11 is a cross section of circumferentially arranged hanger assemblies of FIG. 10 with the spline seal of FIG. 6.

FIG. 11 illustrates is a cross section of the first hanger segment 109 and a second hanger segment 209 taken at the intersection 430. The first confronting end face 412 of the first hanger segment 109 confronts a second confronting end face 512 of the second hanger segment 209. The second hanger segment 209 can include a first channel 522 and a second channel 524 that can, at least a part, confront first and second channels 422, 424, respectively, of the first hanger segment 109. The first and second hanger segments 109, 209 confront similarly to the first and second hanger segments 109, 209.

Similarly to the first depth 468 of the first hanger segment 109, a first depth 568 of the second hanger segment 209 can be defined as the distance from the second confronting end face 512 to a front edge 592 adjacent the first channel 522. A second depth 584 can be defined as the distance from the second confronting end face 512 to a lower back junction 576 of the second channel 524. Another ledge 591 can be defined where the second depth 584 of the second channel 524 is greater than the first depth 568 of the first channel 522.

The first dimension 340 can be defined as the distance from a junction to an edge of the confronting ledge. That is, the first dimension 340 can be measure from the lower back junction 476 to the confronting front edge 592. Alternatively, the first dimension 340 can be measured from the lower back junction 576 to the confronting front edge 492. A second dimension 342 can be measured between confronting lower back junctions 476, 576.

The spline seal 114 can cover both first channels 422, 522 and overlie both ledges 491, 591 at the intersection 430. The intersection spline width 332 of the spline seal 114 is at least greater than the first dimension 340 and less than the second dimension 342.

Optionally, a vertical spline seal 338 can be provided in the first channels 422, 522 that penetrate the first and second confronting end faces 412, 512. It is contemplated that any number of seals can be used between the first and second confronting end faces 412, 512.

Benefits include reducing cooling air leakage between adjacent flow path segments in gas turbine engines. Specifically, the spline seal described herein can minimize chute leakage between channels in a multi-channel assembly. This can maximize efficiency and lower specific fuel consumption.

It should be appreciated that application of the disclosed design is not limited to turbine engines with fan and booster sections, but is applicable to turbojets and turboprop engines as well.

This written description uses examples to describe aspects of the disclosure described herein, including the best mode, and also to enable any person skilled in the art to practice aspects of the disclosure, including making and using any devices or systems and performing any incorporated methods. The patentable scope of aspects of the disclosure is defined by the claims, and may include other examples that occur to those skilled in the art. Such other examples are intended to be within the scope of the claims if they have structural elements that do not differ from the literal language of the claims, or if they include equivalent structural elements with insubstantial differences from the literal languages of the claims.

Further aspects of the invention are provided by the subject matter of the following clauses:

1. A turbine engine comprising an inner rotor/stator and having a longitudinal axis, an outer rotor/stator circumscribing at least a portion of the inner rotor/stator, with at least one of the inner or outer rotor/stator rotating about the longitudinal axis, and having at least one component comprising a plurality of circumferentially arranged component segments having confronting pairs of circumferential ends, and a multi-channel spline seal comprising a first set of first and second channels located in one of the circumferential ends, the first and second channels intersecting to form an intersection, the first channel having a first depth at the intersection, the second channel having a second depth at the intersection, and the second depth being greater than the first depth to define a ledge adjacent the first channel, and a spline seal located within the second channel and having a width at the intersection such that the spline seal at least partially covers the first channel and at least partially overlies the ledge.

2. The turbine engine of any preceding clause wherein the multi-channel spline seal comprises a second set of first and second channels in the other of the circumferential ends to define confronting pairs of first channels and second channels.

3. The turbine engine of any preceding clause wherein the spline seal is located within the confronting pair of second channels.

4. The turbine engine of any preceding clause wherein the second channel of the second set has a first depth greater than the second depth of the first channel of the second set to define another ledge.

5. The turbine engine of any preceding clause wherein the spline seal at least partially covers both first channels and at least partially overlies both ledges at the intersection.

6. The turbine engine of any preceding clause wherein the confronting pair of second channels have corresponding back walls or lower back junctions, and the spline seal has a width at the intersection that is at least greater than a first dimension from one of the back walls or the lower back junctions to an edge of the confronting ledge.

7. The turbine engine of any preceding clause wherein a second dimension is defined between the confronting back walls or lower back junctions and the width of the spline seal at the intersection is between the first and second dimensions.

8. The turbine engine of any preceding clause wherein at least one of the first and second depths is constant for the length of the corresponding at least one first and second channel.

9. The turbine engine of any preceding clause wherein the intersection is located at a terminal end of at least one of the first and second channels.

10. The turbine engine of any preceding clause wherein the intersection is located at an interim point of at least one of the first and second channels.

11. The turbine engine of any preceding clause wherein the first and second channels intersect at a non-right angle.

12. The turbine engine of any preceding clause wherein the at least one component comprises at least one of a shroud, vane, nozzle, nozzle body, combustor, hanger, or blade.

13. The turbine engine of any preceding clause wherein the first set of first and second channels comprises multiple first channels, each forming an intersection with the second channel.

14. A component for a turbine engine comprising a plurality of circumferentially arranged component segments having confronting pairs of circumferential ends and a multi-channel spline seal comprising a first set of first and second channels located in one of the circumferential ends, the first and second channels intersecting to form an intersection, the first channel having a first depth at the intersection, the second channel having a second depth at the intersection, and the second depth being greater than the first depth to define a ledge adjacent the first channel, and a spline located within the second channel and having a width at the intersection such that the spline at least partially covers the first channel and at least partially overlies the ledge.

15. The turbine engine of any preceding clause wherein the multi-channel spline seal comprises a second set of first and second channels in the other of the circumferential ends to define confronting pairs of first channels and second channels.

16. The turbine engine of any preceding clause wherein the spline is located within the confronting pair of second channels.

17. The turbine engine of any preceding clause wherein the second channel of the second set has a depth greater than the depth of the first channel of the second set to define another ledge.

18. The turbine engine of any preceding clause wherein the spline at least partially covers both first channels and at least partially overlies both ledges at the intersection.

19. The turbine engine of any preceding clause wherein the second channels have corresponding back walls or lower back junctions, and the spline has a width at the intersection that is at least greater than a first dimension from one of the back walls or the lower back junctions to an edge of the confronting ledge.

20. The turbine engine of any preceding clause wherein a second dimension is defined between the confronting back walls or lower back junctions and the width of the spline at the intersection is between the first and second dimensions.

What is claimed is:

1. A turbine engine having a longitudinal axis comprising:

a stator component disposed about the longitudinal axis, and comprising a plurality of circumferentially arranged component segments having confronting pairs of circumferential ends; and a multi-channel spline seal comprising:

a first set of first and second channels located in one of the circumferential ends, the first and second channels intersecting to form an intersection, the first channel having a first depth at the intersection, the second channel having a second depth at the intersection, and the second depth being greater than the first depth to define a ledge adjacent the first channel; and a spline seal located within the second channel and having a width at the intersection such that the spline seal at least partially covers the first channel and at least partially overlies the ledge.

2. The turbine engine of claim 1 wherein the multi-channel spline seal comprises a second set of first and second channels in the other of the circumferential ends to define confronting pairs of first channels and second channels.

3. The turbine engine of claim 2 wherein the spline seal is located within the confronting pair of second channels.

4. The turbine engine of claim 3 wherein the second channel of the second set has a first depth greater than the second depth of the first channel of the second set to define another ledge.

5. The turbine engine of claim 4 wherein the spline seal covers the confronting pair of first channels and at least partially overlies both ledges at the intersection.

6. The turbine engine of claim 4 wherein the confronting pair of second channels have corresponding back walls or lower back junctions, and the spline seal has a width at the intersection that is at least greater than a first dimension from one of the back walls or the lower back junctions to an edge of the confronting ledge.

7. The turbine engine of claim 6 wherein a second dimension is defined between the corresponding back walls or the lower back junctions and the width of the spline seal at the intersection is between the first and second dimensions.

8. The turbine engine of claim 1 wherein at least one of the first and second depths is constant for the length of the corresponding at least one first and second channel.

9. The turbine engine of claim 1 wherein the intersection is located at a terminal end of at least one of the first and second channels.

10. The turbine engine of claim 1 wherein the intersection is located at an interim point of at least one of the first and second channels.

11. The turbine engine of claim 1 wherein the first and second channels intersect at a non-right angle.

12. The turbine engine of claim 1 wherein the stator comprises at least one of a shroud, vane, nozzle, nozzle body, combustor, or hanger.

13. The turbine engine of claim 1 wherein the first set of first and second channels comprises multiple first channels, each forming an intersection with the second channel.

14. A component for a turbine engine comprising:

a plurality of circumferentially arranged component segments having confronting pairs of circumferential ends; and a multi-channel spline seal comprising:

a first set of first and second channels located in one of the circumferential ends, the first and second channels intersecting to form an intersection, the first channel having a first depth at the intersection, the second channel having a second depth at the intersection, and the second depth being greater than the first depth to define a ledge adjacent the first channel; and a spline located within the second channel and having a width at the intersection such that the spline at least partially covers the first channel and at least partially overlies the ledge.

15. The turbine engine of claim 14 wherein the multi-channel spline seal comprises a second set of first and second channels in the other of the circumferential ends to define confronting pairs of first channels and second channels.

16. The turbine engine of claim 15 wherein the spline is located within the confronting pair of second channels.

17. The turbine engine of claim 16 wherein the second channel of the second set has a depth greater than the depth of the first channel of the second set to define another ledge.

18. The turbine engine of claim 17 wherein the spline at least partially covers the confronting pair of first channels and at least partially overlies both ledges at the intersection.

19. The turbine engine of claim 17 wherein the second channels have corresponding back walls or lower back junctions, and the spline has a width at the intersection that is at least greater than a first dimension from one of the back walls or the lower back junctions to an edge of the confronting ledge.

20. The turbine engine of claim 19 wherein a second dimension is defined between the corresponding back walls or the lower back junctions and the width of the spline at the intersection is between the first and second dimensions.

* * * * *